US007303806B1

(12) United States Patent
Tatsuki et al.

(10) Patent No.: US 7,303,806 B1
(45) Date of Patent: Dec. 4, 2007

(54) COMBINATION WRITING BOARD/REFLECTING SCREEN SHEET

(75) Inventors: Koji Tatsuki, Kawagoe (JP); Hideo Takamoto, Chiba (JP); Kazuharu Seki, Tokyo (JP)

(73) Assignee: Kimoto Co., Ltd., Tokyo (JP)

( * ) Notice: Subject to any disclaimer, the term of this patent is extended or adjusted under 35 U.S.C. 154(b) by 0 days.

(21) Appl. No.: 10/111,901

(22) PCT Filed: Nov. 6, 2000

(86) PCT No.: PCT/JP00/07778

§ 371 (c)(1),
(2), (4) Date: Apr. 30, 2002

(87) PCT Pub. No.: WO01/32440

PCT Pub. Date: May 10, 2001

(30) Foreign Application Priority Data

Nov. 4, 1999 (JP) ..... 11-314004

(51) Int. Cl.
*B43L 1/04* (2006.01)
*B43L 1/08* (2006.01)

(52) U.S. Cl. ..... 428/156; 428/141; 359/455

(58) Field of Classification Search ..... 428/141, 428/156, 161, 167; 359/455
See application file for complete search history.

(56) References Cited

U.S. PATENT DOCUMENTS 4,123,590 A * 10/1978 Hasegawa et al. ..... 428/450
5,024,898 A * 6/1991 Pitts et al. ..... 428/511
5,361,164 A * 11/1994 Steliga ..... 359/455
5,547,724 A * 8/1996 Kuribayashi ..... 428/35.8

FOREIGN PATENT DOCUMENTS

JP 409254550 A * 9/1997
JP 11254885 A * 9/1999

* cited by examiner

*Primary Examiner*—Alicia Chevalier
(74) *Attorney, Agent, or Firm*—Bacon & Thomas, PLLC

(57) ABSTRACT

A sheet for a writing board and a reflection type screen has excellent writability and erasability when used as a writing board and excellent anti-glare property without hot spots when used as a reflection type screen. This sheet includes a resin layer presenting a writing surface with unevenness having an arithmetical mean deviation (JIS-B-0601) of 1.0-4.0 μm and a mean spacing of profile irregularities (JIS-B-0601) between adjacent protrusions of 30-300 μm formed by embossing. The resin layer preferably contains as an ultraviolet ray curable resin. Since the unevenness is formed on the resin layer by embossing, ink does not penetrate the resin layer and hence the sheet has excellent erasability.

20 Claims, No Drawings

COMBINATION WRITING BOARD/REFLECTING SCREEN SHEET

TECHNICAL FIELD

The present invention relates to a sheet which serves both as a writing board, for example, a white or colored writing board such as a whiteboard, and as a reflection type screen for a projector such as OHP, slide or film projector.

BACKGROUND ART

In response to requirements for space saving in use of reflection type screens and blackboards or whiteboards, and for more efficient presentation, various boards having both of these two functions have been proposed and used in practice (for example, Japanese Patent Laid-open Publication (Kokai) Nos. 6-27532, 9-230506, 10-287091 and so forth).

In general, a writing board such as a whiteboard is required to have a smooth surface so that a user can write with a water-based pen and erase the writing. However, a reflection type screen is required to reflect light without glare so that the reflected light can be easily viewed as an image.

Therefore, a conventional board used as both a reflection type screen and a writing board is imparted with writability and erasability for water-color ink by providing a substrate with a resin layer such as an aromatic polyester or fluororesin having low wettability or easy erasability for a water-color ink, and the board surface is made with reduced gloss to suppress glare. In order to reduce gloss of the board surface, a pigment and a light diffusion agent are usually incorporated into the resin layer.

However, when a layer containing pigments or the like is formed on a surface, a problem arises that an ink easily penetrates between pigment particles, and that the ink, once penetrated, cannot be erased even when the surface is wiped. Moreover, when pigments are present, attainment of proper unevenness (protrusions and depressions) on the board surface is difficult, and it is difficult to form unevenness providing both ink erasability and anti-glare on the surface.

In particular, the phenomenon whereby an image is hard to see due to the brightness in the center of the light-shed area (so-called hot spot) is problematic in a reflection type screen used with modern projectors having high optical power. A conventional writing board also serving as a reflection type screen has the problem that this hot spot cannot be completely eliminated and hence a projected image is hard to see.

SUMMARY OF THE INVENTION

Accordingly, an object of the present invention is to provide a sheet for a writing board/reflection type screen which is excellent both as a writing board and as a reflection type screen. That is, the object is to provide a sheet for a writing board/reflection type screen which is both excellent in writability and erasability when used as a writing board and excellent in reduced glare without generation of hot spots when used as a reflection type screen.

In order to achieve the above object, the sheet for a writing board/reflection type screen of the present invention is provided with a resin layer, enabling writing and erasing with a writing board pen, on at least one surface of a substrate, with unevenness formed on the resin layer by embossing. In the present invention, "sheet" includes from a film to a thin plate, irrespective of presence or absence of flexibility.

By forming unevenness by embossing, the sheet of the present invention has a surface wherein an ink does not penetrate into the resin layer, unlike the prior art where pigments are used, which surface provides the desired light diffusion, thereby giving excellent performance as both a reflection type screen and a writing board. When the surface of the sheet has deep and steep depressions, erasability is poor. However, formation of such deep and steep depressions is prevented when roughness is imparted by embossing.

Embossing can be performed from the substrate side or the resin layer side, but embossing from the substrate side is particularly preferred. When embossing is performed from the resin layer side, a depression corresponding to a protrusion of an embossing roll or an embossing plate is formed in the resin layer surface. When embossing is performed from the substrate side, a protrusion corresponding to a protrusion of the embossing roll or the embossing plate is formed. The ink adhering to this protrusion is more easily wiped off, as compared with ink adhering within a depression, and hence erasability is improved. Further, when the sheet is used for a reflection type screen, glare is reduced since a portion of outdoor daylight falling on a planar portion is scattered by a protruded portion.

Unevenness formed on the resin layer in the sheet for a writing board/reflection type screen of the present invention has an arithmetical mean deviation Ra (JIS-B-0601) of 1.0-4.0 μm and a mean spacing of profile irregularities between adjacent protruded portions (peaks) Sm (JIS-B-0601) of 30-300 μm.

Further, it is preferable that the resin layer on the sheet for a writing board/reflection type screen of the present invention is composed mainly of an ionizing radiation curable resin. As the ionizing radiation curable resin, for example, an ultraviolet curable resin is used.

In one aspect of the writing board/reflection type screen of the present invention, the substrate is a plastic film.

Further, in another aspect of the writing board/reflection type screen of the present invention, the substrate has a tacky layer or an adhesion layer on the surface opposite the surface on which the resin layer is formed. Consequently, the sheet of the present invention can be bonded to an arbitrary object such as a metal plate, whiteboard, magnet sheet or wall, so as to allow use as a writing board and/or a reflection type screen.

DESCRIPTION OF THE PREFERRED EMBODIMENTS

Preferred embodiments of the writing board and the reflection type screen of the present invention will be explained in detail hereinafter.

The writing board/reflection type screen of the present invention comprises a substrate and a resin layer formed on the substrate as its essential structure. The sheet for a writing board/reflection type screen of the present invention may be used as a writing board or as a reflection type screen as is or may be bonded to another structure.

The substrate may be a plastic sheet, a metal plate or the like, but the preferred material is one that can be embossed from the substrate side. Examples of such material include resin sheets made of a homopolymer or copolymer of (meth)acrylic acid esters such as methyl methacrylate and methyl acrylate, polyesters such as polyethylene terephthalate, polycarbonates, polyvinyl chloride, polystyrenes, fluororesin and the like.

Further, when the sheet for a writing board/reflection type screen of the present invention is used as a writing board or a reflection type screen as is, at least a surface of a film or sheet used as a substrate on which the resin layer is formed has high reflectivity, for example, reflectivity of 90% or higher. Such a substrate may be the aforementioned resin sheet, sheets having a surface deposit of a metal such as aluminum or having a reflective layer of aluminum paste, or a resin sheet admixed with white pigment. In particular, a sheet of resin admixed with white pigment is preferred in order to suppress hot spots and to improve reflection.

When the sheet for a writing board/reflection type screen of the present invention is bonded to another material such as a metal plate, the substrate itself does not need to be reflective, and a transparent substrate may be used. As the transparent substrate, the aforementioned resin sheet may be used, and a flexible resin sheet is preferred. However, when the material bonded with the sheet of the present invention does not have high reflectivity, the substrate itself preferably has a surface with high reflectivity.

The thickness of the substrate is not particularly limited but is preferably in the range of 10-300 μm, more preferably in the range of 20-200 μm in view of bonding workability, costs and so forth when the sheet of the present invention is bonded to another material such as a metal plate. In particular, when embossing is performed from the substrate side, the substrate preferably has a thickness of less than 150 μm, more preferably less than 100 μm.

The resin layer is made of a resin on which a user can write with a writing board pen and erase the writing. Examples of such a resin include ionizing radiation curable resins such as an ultraviolet ray curable resins and electron beam curable resins, thermosetting resins such as epoxy resins, phenol resins, melamine resins, urethane resins, alkyd resins, fluororesins and so forth.

Among these, ionizing radiation curable resins are preferred due to their particularly high abrasion resistance and excellent writability and erasability with use of a writing pen such as a pen with a water-based ink. In order to obtain such effects, the content of the ionizing radiation curable resin preferably accounts for 90% by weight or higher of the resin layer.

The ionizing radiation curable resin is crosslinked and cured by irradiation with ionizing radiation (ultraviolet rays or electron beams), and a resin having an acrylic group such as epoxy acrylate, polyester acrylate, polyurethane acrylate or polyalcohol acrylate or a photopolymerization prepolymer such as a polythiol polyene resin may be used.

Each of these resins can be used alone, but a photopolymerization monomer is preferably added to improve hardness of the crosslinked and cured film. The photopolymerization monomer can be one or more of monofunctional acrylic monomers such as 2-ethylhexyl acrylate, 2-hydroxy ethylacrylate, 2-hydroxy propyl acrylate and butoxy ethylacrylate, bifunctional acrylic monomers such as 1,6-hexane diol acrylate, neopentyl glycol diacrylate, diethylene glycol diacrylate, polyethylene glycol diacrylate and hydroxy pivalate ester neopentyl glycol acrylate, polyfunctional acrylic monomers such as dipentaerythritol hexaacrylate, trimethyl propane triacrylate and pentaerythritol triacrylate and so forth.

In addition to the photopolymerization prepolymers and photopolymerization monomers mentioned above, as the ionizing radiation curable resin layer, a photopolymerization initiator, ultraviolet ray sensitizer and the like are preferably added when the resin is cured by ultraviolet ray irradiation. The photopolymerization initiator may be a radical photopolymerization initiator such as benzoin ether, ketal, acetophenone and thioxanthone, diazonium salt, diaryliodonium salt, triarylsulfonium salt, triarylbilirium salt, benzylpyridinium thiocyanate, dialkyl phenacylsulfonium salt, dialkyl hydroxy phenyl sulfonium salt and dialkylhydroxy phenyl phosphonium salt, composite caotinic photopolymerization initiators and so forth.

Further, in order to improve workability when unevenness is formed by embossing, hardness can also be adjusted by mixing a non-reactive resin having excellent flexibility so long as the effect of the ionizing radiation curable resin is not inhibited. As such a non-reactive resin, thermosetting or thermoplastic acrylic resins, polyester resins, epoxy resins and so forth can be used.

In order to form unevenness on a resin layer by embossing, the substrate surface is coated with an uncured paint of the aforementioned ionizing radiation curable resin and irradiated with electron beams or ultraviolet rays to cure the paint, and then an embossing roll or an embossing plate having a predetermined pattern of unevenness is pressed to impart that unevenness on the resin layer surface. During this application of pressure, heat is applied as required. Alternatively, while being embossed with a shape having predetermined unevenness, the uncured ionizing radiation curable resin may be irradiated with electron beams or ultraviolet rays, followed by removal of the shape from the resin layer surface.

Further, the substrate surface may be coated with a paint containing an ionizing radiation curable resin, which is cured to form a resin layer, and an embossing roll or an embossing plate may be pressed against the substrate side to impart unevenness to the resin layer surface.

The unevenness preferably has an arithmetical mean deviation (Ra) in the range of 1.0-4.0 μm, more preferably in the range of 1.5-3.0 μm. The mean value of distances between adjacent protrusions (mean spacing of profile irregularities) is preferably in the range of 30-300 μm, more preferably in the range of 100-280 μm. It is preferable that shapes of irregularities have a relatively smooth gradient without deep depressions.

Within these ranges, hot spots can be effectively prevented when the sheet is used for a reflection type screen, and further excellent erasability can be obtained when a user writes on the sheet with a pen. Further, since unevenness is formed by embossing, ink does not soak into a resin layer, and merely by wiping, the writing can be completely erased. When the resin is cured before embossing, a surface having particularly excellent erasability can be obtained. Further, since protrusions corresponding to the protrusions on the embossing roll or embossing plate are formed when embossing is performed from the substrate side, ink erasability is further improved, and, when the sheet is used for a reflection type screen, the anti-glare property is improved since a part of the outdoor daylight striking a planar portion is scattered by the protrusions.

The thickness of the resin layer is not particularly limited, but is preferably in the range of 3-15 μm. When the resin layer is thinner than 3 μm, hardness of the resin layer is insufficient, thereby reducing durability and erasability. Further, when the resin layer is too thick, cracks may occur in a layer upon embossing.

When a surface of a material used as a substrate on which a resin layer is formed has reflectivity, the sheet for a writing board/reflection type screen of the present invention may be used as a writing board/reflection type screen as is or by bonding the sheet to another planar material with an adhesive or the like.

Further, the sheet for a writing board/reflection type screen of the present invention may have a structure in which a tacky layer or an adhesion layer is formed beforehand on a substrate surface opposite the surface on which the resin layer is formed. In this case, the sheet bonded to a metal plate such as iron and aluminium, a board or the like, via the tacky layer or the adhesion layer, is used as the writing board/reflection type screen.

The tacky layer or the adhesion layer is formed by coating a known adhesive such as a pressure-sensitive adhesive or a thermo-sensitive adhesive.

The pressure-sensitive adhesives include known glues such as elastomer glues, synthetic resin glues such as those of silicone, epoxy, urethane and cyanoacrylate and emulsion glues. Suitable thermo-sensitive adhesives include hot melt adhesives, and known thermal melting resins such as ethylene/vinyl acetate copolymer resins, ethylene/acrylic copolymer resins, polyurethane resins and thermoplastic elastomer resins.

The thickness of the tacky layer or the adhesion layer is not particularly limited, but is usually about 10-300 μm.

The material to which the sheet is bonded is not limited so long as it is planar, but when the substrate is transparent, a metal plate having high reflectivity such as an iron plate or an aluminium plate or a plate colored white or gray is preferred.

Since pigments are not contained in the resin layer but, rather, specific unevenness is formed in the sheet of the present invention, this sheet has excellent writability when used as a writing board, and the writing can be readily erased by wiping with a felt or the like. When the sheet is used as a reflection type screen, light is scattered by the irregularities on the surface of the resin layer. Therefore, a projected image can be easily seen and hot spots can be effectively prevented.

EXAMPLES

Examples of the present invention will be explained hereinafter. In the following examples, the arithmetical mean deviation and the mean spacing of profile irregularities are values measured according to JIS-B-0601.

Example 1

One surface of a polyester film having a thickness of 50 μm (Lumirror E20: Toray Industries, Inc.) was coated with an ultraviolet ray curable resin paint (Adeka Optomer KR566: Asahi Denka Kogyo K.K.), which was cured by irradiation with ultraviolet rays to form a resin layer having a thickness of 9 μm. An embossing roll was heated and pressed on the surface of this resin layer to form unevenness having an arithmetical mean deviation Ra of 2.0 μm and a mean spacing of profile irregularities Sm of 150 μm, and thus a sheet for a writing board/reflection type screen was obtained.

One line was drawn by using a Whiteboard Marker Black (SAKURA COLOR PRODUCTS CORPORATION) on the thus prepared sheet, and the line was erased with a commercially available whiteboard marker eraser to evaluate erasability. The result is shown in Table 1. In the evaluation of erasability, when no mark remained after wiping with a marker eraser only once, "◎" was given. When the mark remained somewhat after wiping once but could be erased by wiping again, "o" was given. When the mark could be erased after wiping 3-5 times, "Δ" was given. When the mark could not be erased even after wiping many times, "x" was given.

Further, an image was projected on this sheet using a liquid crystal projector (ELP-3500: Seiko Epson Corporation), and generation of hot spots was observed to evaluate the anti-glare property. The result is also shown in Table 1. In the table, "o" indicates that no hot spot was observed, and "x" indicates that a hot spot was observed.

Examples 2-11 and Comparative Examples 1-5

Sheets having a resin layer formed on a substrate were prepared in the same manner as in Example 1 except that the arithmetical mean deviation Ra and the mean spacing of profile irregularities Sm of unevenness formed on the resin layer were changed. These sheets were also evaluated with regard to erasability after writing with a marker and with regard to generation of hot spots upon projection by a projector (anti-glare property) as in Example 1. The results are shown in Table 1.

Example 12

One surface of a polyester film having a thickness of 50 μm (Lumirror E20: Toray Industries, Inc.) was coated with the same ultraviolet ray curable resin paint as in Example 1, which was cured by irradiation with ultraviolet rays to form a resin layer having a thickness of 9 μm. Then, an embossing roll was heated and pressed against the surface opposite the polyester film resin layer to form unevenness having an arithmetical mean deviation Ra of 2.0 μm and a mean spacing of profile irregularities Sm of 150 μm, and thus a sheet for a writing board/reflection type screen was obtained.

This sheet was also evaluated for erasability after writing with a marker and for generation of hot spots upon projection by a projector (anti-glare property) as in Example 1. The results are shown in Table 1.

Comparative Example 6

One surface of the same polyester film as used in Example 1 was coated with a paint obtained by adding a pigment to the same ultraviolet ray curable resin as used in Example 1, which was cured by irradiation with ultraviolet rays to form a resin layer having unevenness on the surface. As the pigment, 15 weight parts of silicone resin particles having a mean particle diameter of 3 μm (Tospearl 130: Toshiba Silicone Co., Ltd.) to 100 weight parts of a resin was used. The unevenness on the sheet surface prepared as described above had an arithmetical mean deviation Ra of 2.0 μm and a mean spacing of profile irregularities Sm of 150 μm, almost the same as the unevenness as obtained in Example 1.

This sheet was also evaluated for erasability after writing with a marker and for generation of hot spots upon projection by a projector (anti-glare property) as in Example 1. The results are shown in Table 1.

TABLE 1

| Example | Ra (μm) | Sm (μm) | Erasability | Hot spot |
|---|---|---|---|---|
| Example 1 | 2.0 | 150 | ○ | ○ |
| Example 2 | 2.0 | 180 | ○ | ○ |
| Example 3 | 2.0 | 120 | ○ | ○ |
| Example 4 | 2.0 | 200 | ○ | ○ |
| Example 5 | 2.0 | 50 | Δ | ○ |
| Example 6 | 1.0 | 50 | ○ | ○ |
| Example 7 | 1.5 | 150 | ○ | ○ |
| Example 8 | 1.5 | 280 | ○ | ○ |
| Example 9 | 2.5 | 150 | ○ | ○ |
| Example 10 | 2.8 | 180 | ○ | ○ |

TABLE 1-continued

| Example | Ra (μm) | Sm (μm) | Erasability | Hot spot |
|---|---|---|---|---|
| Example 11 | 3.0 | 250 | ○ | ○ |
| Example 12 | 2.0 | 150 | ○ | ○ |
| Comparative example 1 | 0.5 | 150 | ○ | x |
| Comparative example 2 | 5.0 | 150 | x | ○ |
| Comparative example 3 | 2.0 | 400 | ○ | x |
| Comparative example 4 | 0.7 | 20 | x | x |
| Comparative example 5 | 4.5 | 350 | x | x |
| Comparative example 6 | 2.0 | 150 | x | ○ |

As shown in the results in Table 1, by setting the arithmetical mean deviation and the mean spacing of profile irregularities to be in respective predetermined ranges, excellent performance was exhibited in both erasability and anti-glare property. On the other hand, when only either the arithmetical mean deviation or the mean spacing of profile irregularities was in the predetermined range and the other was outside of the predetermined range (Comparative examples 1-3), a sheet exhibiting satisfactory performance in both erasability and anti-glare property could not be obtained. Further, when the mean spacing of profile irregularities was small and the arithmetical mean deviation was relatively large (Example 5), erasability was slightly reduced, but even though the mean spacing of profile irregularities was small, erasability could be improved by making the arithmetical mean deviation smaller (Example 6). Further, when embossing was performed from the substrate side (Example 12), excellent ink erasability was obtained. Further, no hot spot was observed, and hence excellent anti-glare property was exhibited.

When unevenness was provided by a chemical matte (Comparative example 6), an ink penetrated between pigment particles and could not be wiped off even when the arithmetical mean deviation and the mean spacing of profile irregularities were the same as those in Example 1. In contrast when unevenness was formed by embossing, the problem of ink penetrating the resin layer did not arise, and excellent erasability was exhibited.

As shown in the above examples, the present invention provides a substrate with a resin layer with an unevenness formed by embossing, a sheet for a writing board/reflection type screen which is excellent in writability and erasability when used as a writing board and excellent in suppressing glare without generation of hot spots when used as a reflection type screen. Particularly when the embossing is performed from the substrate side, a sheet for a writing board/reflection type screen which has both excellent ink erasability and anti-glare property can be obtained.

Further, according to the present invention, by providing a tacky layer or an adhesion layer on a substrate surface opposite the surface on which the resin layer is provided, there is provided a sheet for a writing board/reflection type screen which can be bonded on a metal plate, a whiteboard or the like.

The invention claimed is:

1. A planar sheet for a writing board and a reflection screen comprising a substrate and a resin layer formed on said substrate, said resin layer presenting an erasable and exposed surface, said erasable and exposed surface having embossing providing said erasable and exposed surface with unevenness to facilitate writing thereon with a writing board pen, wherein said erasable and exposed surface has an arithmetical mean deviation (JIS-B-0601) of 1.0-3.0 μm and a mean spacing of profile irregularities between adjacent protrusions (JIS-B-0601) of 30-300 μm.

2. The sheet according to claim 1, wherein the embossing is performed from the substrate side.

3. The sheet according to claim 1, wherein the thickness of the resin layer is in the range of 3-15 μm.

4. The sheet according to claim 1, wherein the substrate is a plastic film.

5. The sheet according to claim 1, wherein the substrate has a tacky layer or an adhesion layer on a surface opposite the surface on which the resin layer is formed.

6. The sheet according to claim 1 wherein said arithmetical mean deviation is 1.5-3.0 μm.

7. The sheet according to claim 1 wherein said mean spacing of profile irregularities between adjacent protrusions is 100-280 μm.

8. The sheet according to claim 1 wherein said arithmetical mean deviation is 1.0-2.8 μm.

9. The sheet according to claim 1 wherein the resin layer is formed on a surface of a substrate having a thickness of less than 150 μm, said substrate being a homopolymer or copolymer selected from the group consisting of (meth) acrylic acid esters, polyesters, polycarbonates, polyvinyl chloride, polystyrenes and fluororesins.

10. The sheet according to claim 9 wherein said surface is reflective.

11. A planar sheet for a writing board and a reflection screen comprising a substrate and a resin layer containing an ionizing radiation curable resin and formed on said substrate, said resin layer presenting an erasable and exposed surface, said erasable and exposed surface having embossing providing said erasable and exposed surface with unevenness to facilitate writing thereon with a writing board pen, wherein said erasable and exposed surface has an arithmetical mean deviation (JIS-B-0601) of 1.0-3.0 μm and a mean spacing of profile irregularities between adjacent protrusions (JIS-B-0601) of 30-300 μm.

12. The sheet according to claim 11, wherein the ionizing radiation curable resin is an ultraviolet ray curable resin.

13. The sheet according to claim 11, wherein the thickness of the resin layer is in the range of 3-15 μm.

14. The sheet according to claim 11, wherein the substrate is a plastic film.

15. The sheet according to claim 11, wherein the substrate has a tacky layer or an adhesion layer on a surface opposite the surface on which the resin layer is formed.

16. The sheet according to claim 11 wherein said arithmetical mean deviation is 1.5-3.0 μm.

17. The sheet according to claim 11 wherein said mean spacing of profile irregularities between adjacent protrusions is 100-280 μm.

18. The sheet according to claim 11 wherein said arithmetical mean deviation is 1.0-2.8 μm.

19. The sheet according to claim 11 wherein the resin layer is formed on a surface of a substrate having a thickness of less than 150 μm, said substrate being a homopolymer or copolymer selected from the group consisting of (meth) acrylic acid esters, polyesters, polycarbonates, polyvinyl chloride, polystyrenes and fluororesins.

20. The sheet according to claim 19 wherein said surface is reflective.

* * * * *

UNITED STATES PATENT AND TRADEMARK OFFICE

CERTIFICATE OF CORRECTION

PATENT NO. : 7,303,806 B1
APPLICATION NO. : 10/111901
DATED : December 4, 2007
INVENTOR(S) : Koji Tatsuki et al.

It is certified that error appears in the above-identified patent and that said Letters Patent is hereby corrected as shown below:

On the Title Page, Item (73)

"Assignee: Kimoto Co. Ltd., Tokyo (JP)"
should read:

-- Assignee: KIMOTO CO., LTD., Tokyo (JP)"; and
IZUMI-COSMO CO., LTD., Osaka (JP)"

Signed and Sealed this
Nineteenth Day of April, 2011

David J. Kappos

David J. Kappos
*Director of the United States Patent and Trademark Office*